United States Patent [19]

Gaskell

[11] 4,024,649

[45] May 24, 1977

[54] PAPER RETARDING CONTROL MECHANISM FOR PHOTOGRAPHIC DRYER

[75] Inventor: Alfred J. Gaskell, Hopkins, Minn.

[73] Assignee: Pako Corporation, Minneapolis, Minn.

[22] Filed: Feb. 9, 1976

[21] Appl. No.: 656,242

[52] U.S. Cl. ..... 34/155; 34/117; 34/159; 34/163; 226/95; 226/97; 226/119; 354/339

[51] Int. Cl.² ..... F26B 13/04

[58] Field of Search ..... 34/155, 158, 159, 163, 34/227, 239, 240, DIG. 11, 120, 117; 226/95, 97, 119; 68/50, 20; 432/59, 8; 354/339, 325

[56] References Cited

UNITED STATES PATENTS

| | | | |
|---|---|---|---|
| 2,478,850 | 8/1949 | Trump | 354/339 X |
| 2,553,516 | 5/1951 | French | 34/159 X |
| 3,367,039 | 2/1968 | Jacobsen | 34/159 X |
| 3,609,875 | 10/1971 | Reid | 34/159 |
| 3,834,040 | 9/1974 | Russell et al. | 34/160 |

FOREIGN PATENTS OR APPLICATIONS

| | | | |
|---|---|---|---|
| 2,015,290 | 4/1970 | France | 34/155 |

*Primary Examiner*—William F. O'Dea
*Assistant Examiner*—Harold Joyce
*Attorney, Agent, or Firm*—John W. Adams

[57] ABSTRACT

A mechanism for controlling the loose trailing end of a strip of paper passing through a photographic dryer and includes soft, readily yieldable retarding elements mounted in inclined relation to the downward run of the path of the paper strip through the dryer in generally opposed relation to the discharge of hot drying air from a pressurized distribution plenum. In paper processors individual strips of photographic prints are transported therethrough by being attached at their leading ends to a transport belt which carries the strips through a tortuous path including a downward run with the hot drying air being blown against the surface of the paper to be dried. Since only the leading end of the photographic paper is attached to the transport belt, the trailing end is loose and tends to fall down within the downward run portion of the drying chamber.

5 Claims, 4 Drawing Figures

PAPER RETARDING CONTROL MECHANISM FOR PHOTOGRAPHIC DRYER

The present invention provides a plurality of inclined, readily yieldable retarding finger against which the paper is urged by the force of the drying air directed thereagainst to retard the loose trailing end of paper against the force of gravity and prevent the same from falling down to the bottom of the drying chamber and becoming scratched or otherwise damaged. The use of the inclined, highly yieldable retarding fingers constitutes an improvement over the prior art and assures control of the free trailing end of each of the paper strips during their passage through the dryer unit.

The objects of the invention will more fully appear from the following description made in connection with the drawings in which.

Figure 1:
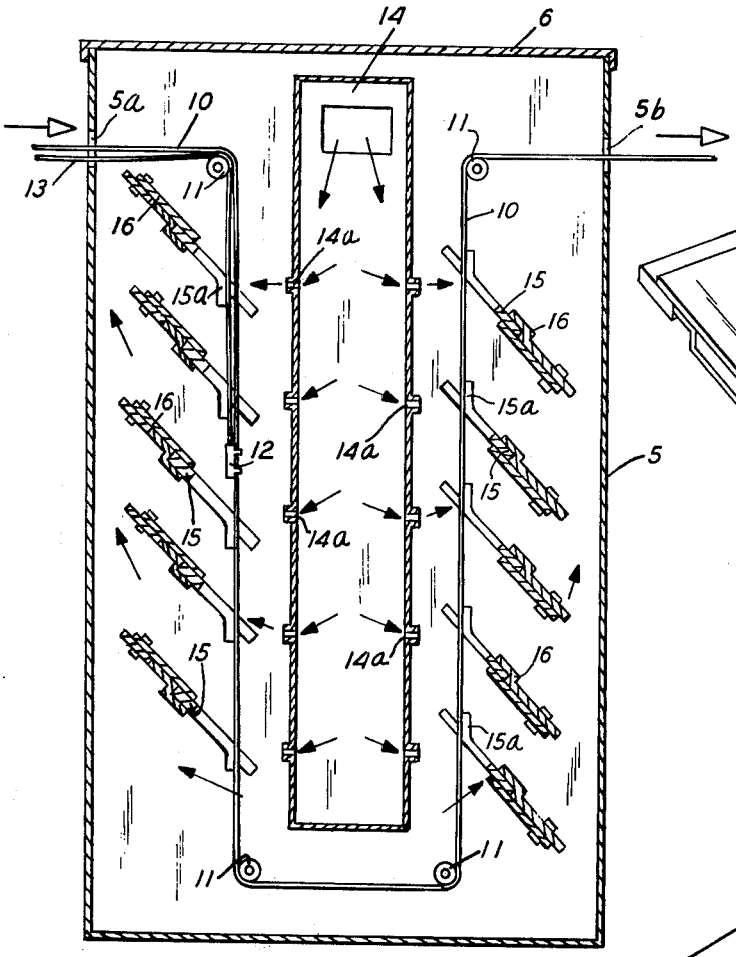
FIG. 1 is a transverse vertical, sectional view through a portion of a dryer embodying this invention.
Figure 2:
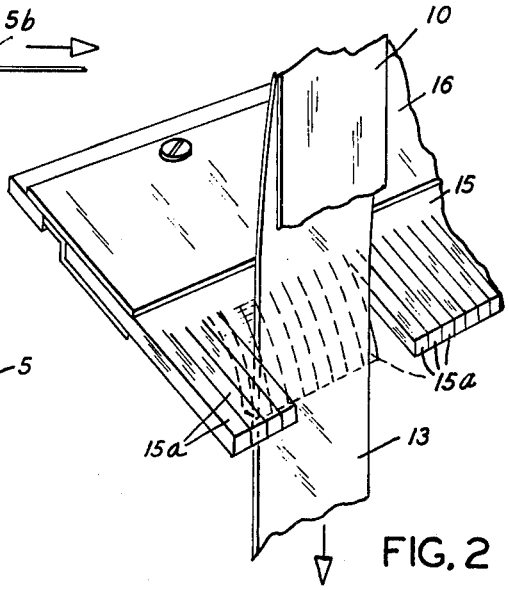
FIG. 2 is a perspective view showing the paper pressed against the inclined, yieldable retarding fingers.
Figure 4:
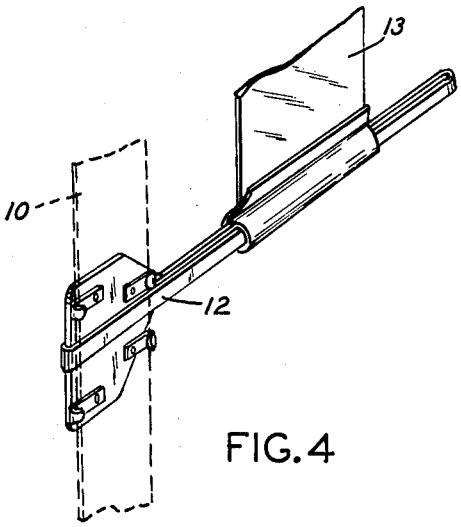
FIG. 4 is a perspective view showing the detail of a typical attachment clip.

FIG. 1 shows a dryer unit which has an outer housing 5 including a top panel 6. A paper entrance opening **5*a* and an exit opening 5*b* are provided in the upper portion of the side wall on the housing 5. The individual lengths of paper are connected to a transport belt 10 which is guided through the machine by a plurality of suitable rollers 11 and passes in through the entrance opening 5*a* and out through the exit opening 5*b*. Suitable clip elements 12 attach the individual strips of paper 13 to the transport belt at the leading end of the strips to pull the paper through the dryer. The details of the clip are best shown in FIG. 4. The paper strips to be dried are thus carried by the belt 10 into the drying chamber within the housing 5, down the first vertical run of the belt around the two bottom rollers 11 and back up to the second vertical run of the belt and around the second upper roller 11 and out through the exit opening 5*b***.

An inner housing 14 is fixed within the main housing 5 and forms an air distribution plenum. The warm air from a suitable lower heating and blower system of conventional design (not shown) supplies air to said plenum and the inner housing 14 is provided with openings **14*a*** through which the warm air is discharged against the strip of photographic paper to be dried.

Figure 3:
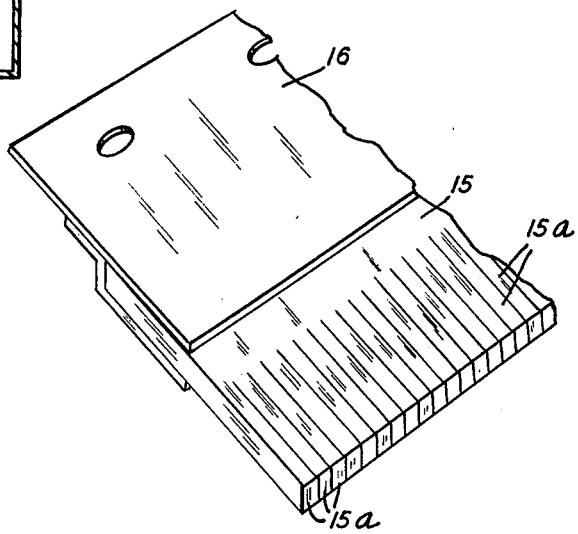
FIG. 3 is a fragmentary perspective view showing the mounting bracket for the inclined retarded fingers.

The drying air discharged through the opening **14*a* urges the strips 13 away from the walls of the plenum and a plurality of spacing apart inclined control elements 15 are mounted in fixed relation in generally opposed relation to the openings 14*a*. FIG. 3 illustrates a suitable mounting bracket 16 for holding the control elements 15 which are of a suitable soft pliable material preferably having a relative coefficient of friction such as conventional foam material available on the market, including, but not specifically limited to, foam rubber. The control element is divided into a pluraltiy of fingers 15*a*** which are individually yieldable when the force of the drying air processes the strip of print paper into engagement therewith.

The inclination of the control elements is approximately 45° which permits substantially easier deflection of the individual fingers then would be possible if the elements were oriented at right angles normal to the path of the strips being transported through the dryer. The 45° inclined angles materially reduces the possibility of tearing off the clip for attaching leading ends of the strips to the transport belt 10, than would be the case if the fingers were disposed in perpendicular relation to the transport path of the strips.

It will be seen that this control mechanism provides a relatively simple yet highly effective system for preventing the loose trailing ends of the paper strips 13 from falling down into the bottom of the drying chamber under the force of gravity during their downward pass through said chamber.

It will of course be understood that various changes may be made in the form, details, arrangment and proportions of the parts without departing from the scope of this invention as set forth in the appended claims.

What is claimed is:

1. A paper retarding control mechanism for a photographic paper dryer of the type which includes a drying chamber having a central air supply and distribution plenum housing formed therein, said plenum having substantially vertical side walls with a plurality of openings therein for discharging drying air laterally outwardly therefrom; and a transport conveyor for carrying a strip of photographic paper material to be dried through said drying chamber, and including a plurality of roller means to define a transport path having portions thereof positioned in opposed relation to said plenum openings so that drying air discharged from said plenum is directed against a strip of material being carried along said opposed portions of said transport path, said paper control mechanism comprising, a plurality of pliable retarding elements inclined in the direction of travel of the conveyor and disposed in vertically spaced apart relation to each other and in opposed outwardly spaced relation to the side wall of plenum with said opposed portions of the conveyor and paper strips being carried thereby being disposed between the plenum and the retarding elements and the air discharged through the openings in the plenum side walls deflecting the paper into engagement with said retarding elements to maintain the paper in generally upstanding relation as it is transported downwardly by the transport conveyor of the dryer.

2. The structure set forth in claim 1 wherein the retarding elements are disposed at approximately 45° to the line of travel of the transport belt and paper.

3. The structure set forth in claim 1 wherein the retarding elements constitute a plurality of individually bendable fingers to maintain stability of the paper along both horizontal axes thereof during its downward travel.

4. The structure set forth in claim 1 wherein the material of the retarding elements constitutes a relatively high frictional yieldable material such as foam rubber.

5. The structure set forth in claim 1 and the flow of air from said openings traveling generally laterally outwardly between the spaced apart retarding elements and back to the central air supply in a path disposed laterally outwardly of said retarding elements.

* * * * *